US009987180B1

(12) United States Patent
Cordero

(10) Patent No.: US 9,987,180 B1
(45) Date of Patent: Jun. 5, 2018

(54) ARMREST EXTENSION DEVICE

(71) Applicant: Ignacio Cordero, Sylmar, CA (US)

(72) Inventor: Ignacio Cordero, Sylmar, CA (US)

( * ) Notice: Subject to any disclaimer, the term of this patent is extended or adjusted under 35 U.S.C. 154(b) by 0 days. days.

(21) Appl. No.: 15/367,646

(22) Filed: Dec. 2, 2016

(51) Int. Cl.
*A47C 7/54* (2006.01)
*A61G 5/12* (2006.01)
*A61G 5/10* (2006.01)

(52) U.S. Cl.
CPC ..... *A61G 5/125* (2016.11); *A61G 5/1051* (2016.11)

(58) Field of Classification Search
CPC ..... A61G 5/125; A61G 5/1051
USPC ..... 297/411.23, 411.26; 248/118, 118.1
See application file for complete search history.

(56) References Cited

U.S. PATENT DOCUMENTS 2,690,212 A * 9/1954 Jakeway ..... A47B 95/043 297/411.26 X
2,968,342 A * 1/1961 Lesser ..... F16B 12/40 297/411.26
3,084,949 A 4/1963 Forster et al.
4,120,530 A 10/1978 Imbro
4,576,351 A * 3/1986 Brink ..... A47C 1/03 297/411.26 X
5,207,477 A * 5/1993 Maxwell ..... A61G 5/10 297/188.18
D359,258 S * 6/1995 Judycki ..... D12/133
5,799,964 A 9/1998 Chao
D407,672 S 4/1999 Wells
6,182,529 B1 2/2001 White
6,511,131 B1 * 1/2003 Harnois ..... A47C 7/70 297/411.23 X
6,827,405 B1 * 12/2004 Roberts ..... A47C 7/546 297/411.23 X
7,396,076 B1 * 7/2008 Hock ..... A47C 7/546 297/411.26 X
8,360,518 B2 1/2013 Braaten
D735,622 S 8/2015 Spalding et al.
9,125,784 B2 * 9/2015 Crisco ..... A61G 13/1235
2009/0315381 A1 * 12/2009 Longnecker ..... B60N 2/4673 297/411.23
2011/0031787 A1 2/2011 Bounds
2014/0339876 A1 * 11/2014 Kisner ..... B60N 2/4673 297/411.23

FOREIGN PATENT DOCUMENTS

WO WO2013166578 11/2013

* cited by examiner

*Primary Examiner* — Rodney B White

(57) ABSTRACT

An armrest extension device for a wheeled chair includes a tube that has a first end and a second end. The first end and the second end are open. The tube has a first side that is open from the second end to proximate to the first end. A handle is coupled to and extends linearly from the first end the tube. A first cutout is positioned in a bottom of the tube proximate to the first end. The first cutout is substantially complementary to a diameter of a frame member that supports an armrest of a wheeled chair. The tube is configured to laterally insert the armrest into the first side, coincident with insertion of the frame member into the first cutout, to couple the tube to the armrest. The handle is configured to be grasped in a hand of a user.

10 Claims, 5 Drawing Sheets

ARMREST EXTENSION DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to armrest extension devices and more particularly pertains to a new armrest extension device for a wheeled chair.

BRIEF SUMMARY OF THE INVENTION

An embodiment of the disclosure meets the needs presented above by generally comprising a tube that has a first end and a second end. The first end and the second end are open. The tube has a first side that is open from the second end to proximate to the first end. A handle is coupled to and extends linearly from the first end the tube. A first cutout is positioned in a bottom of the tube proximate to the first end. The first cutout is substantially complementary to a diameter of a frame member that supports an armrest of a wheeled chair. The tube is configured to laterally insert the armrest into the first side, coincident with insertion of the frame member into the first cutout, to couple the tube to the armrest. The handle is configured to be grasped in a hand of a user.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
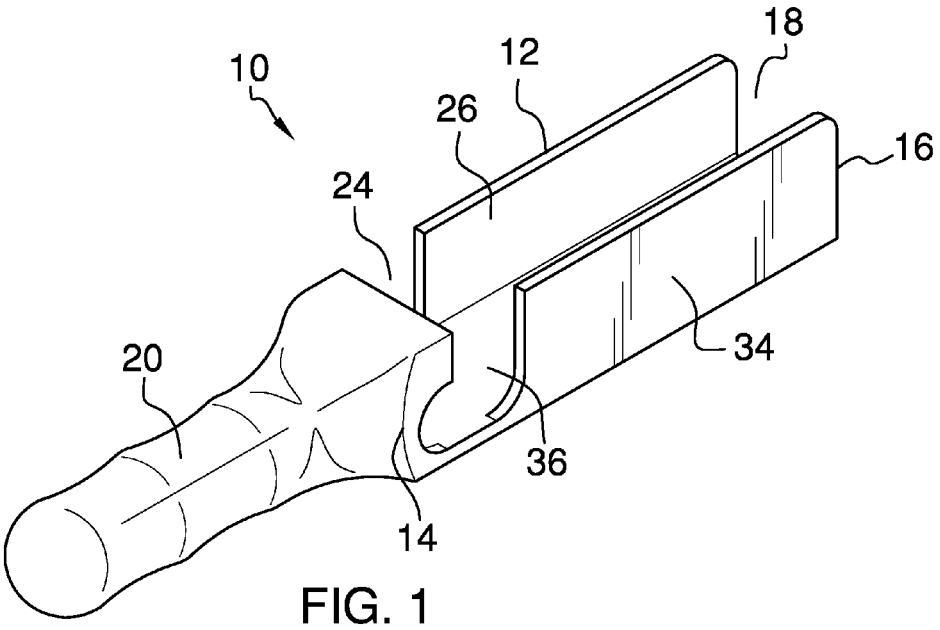
FIG. 1 is an isometric perspective view of an armrest extension device according to an embodiment of the disclosure.
Figure 2:
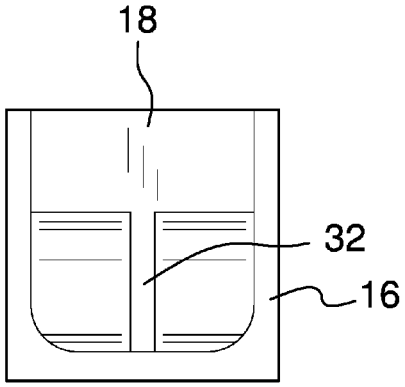
FIG. 2 is an end view of an embodiment of the disclosure.
Figure 3:
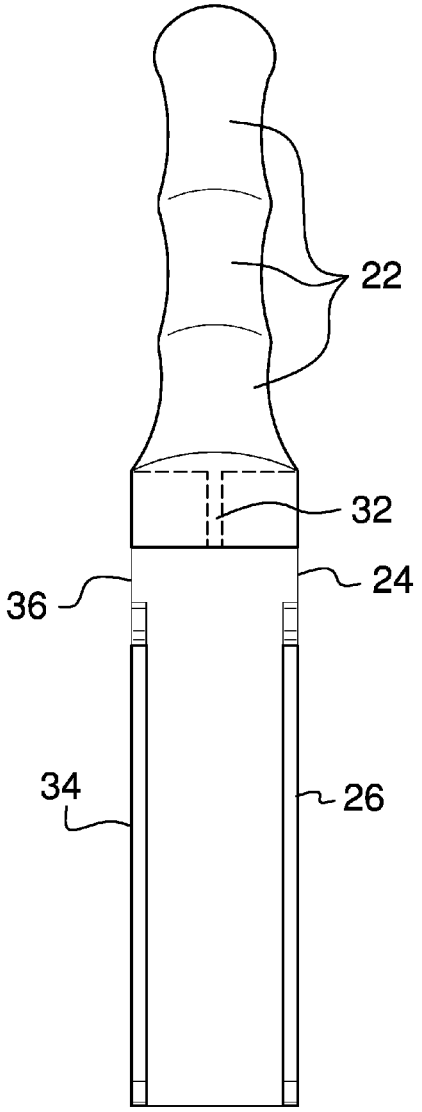
FIG. 3 is a side view of an embodiment of the disclosure.
Figure 4:
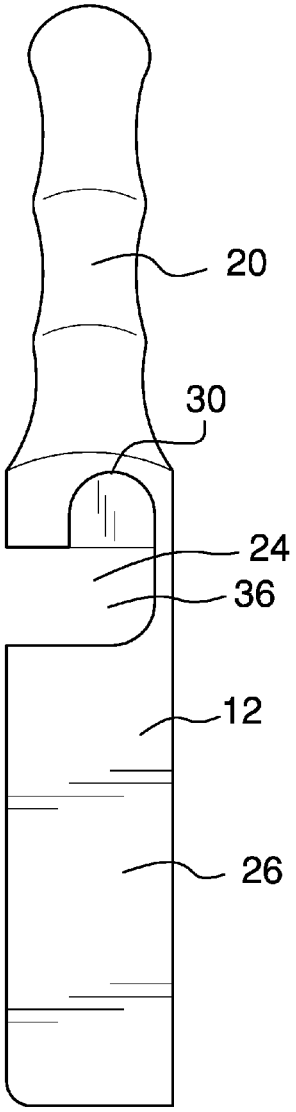
FIG. 4 is a top view of an embodiment of the disclosure.
Figure 5:
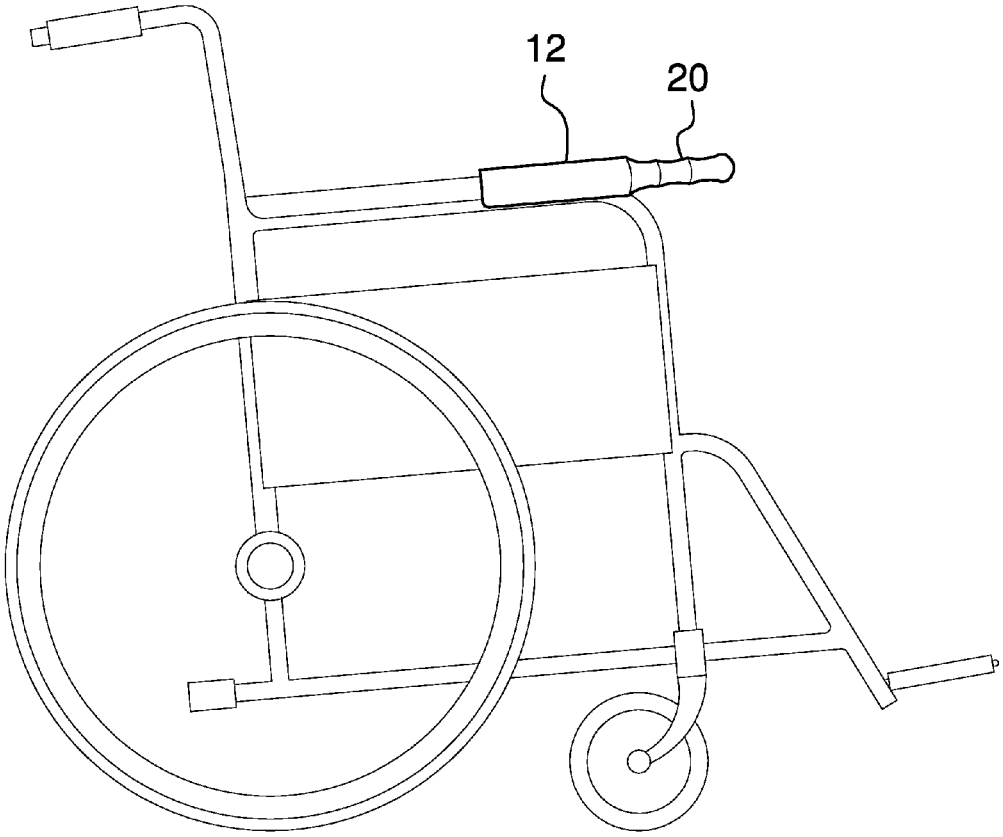
FIG. 5 is an in-use view of an embodiment of the disclosure.
Figure 6:
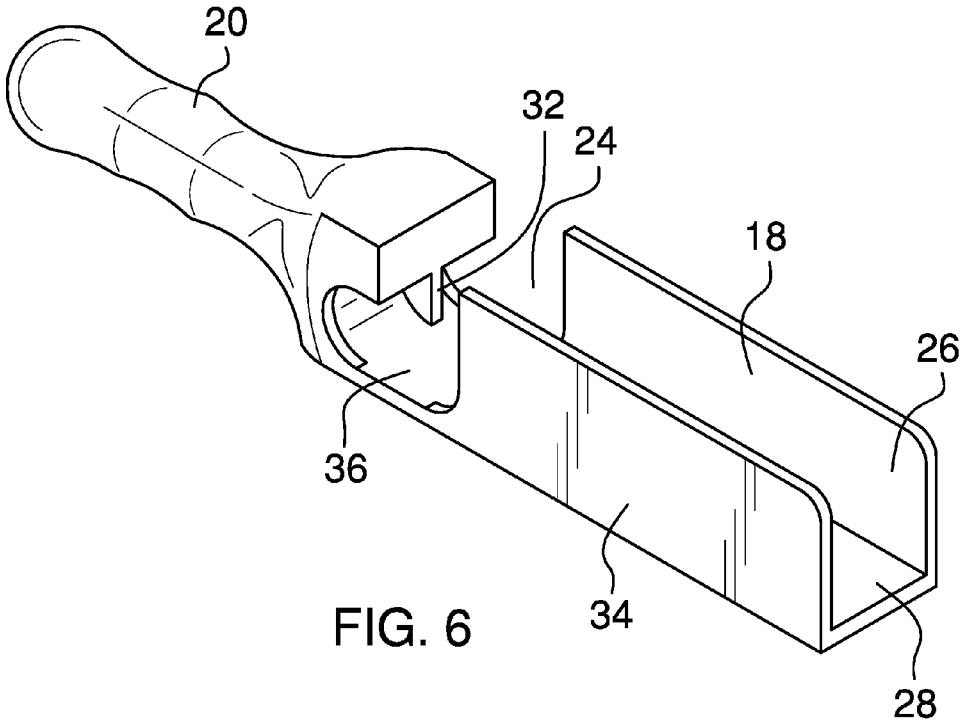
FIG. 6 is an isometric perspective view of an embodiment of the disclosure.
Figure 7:
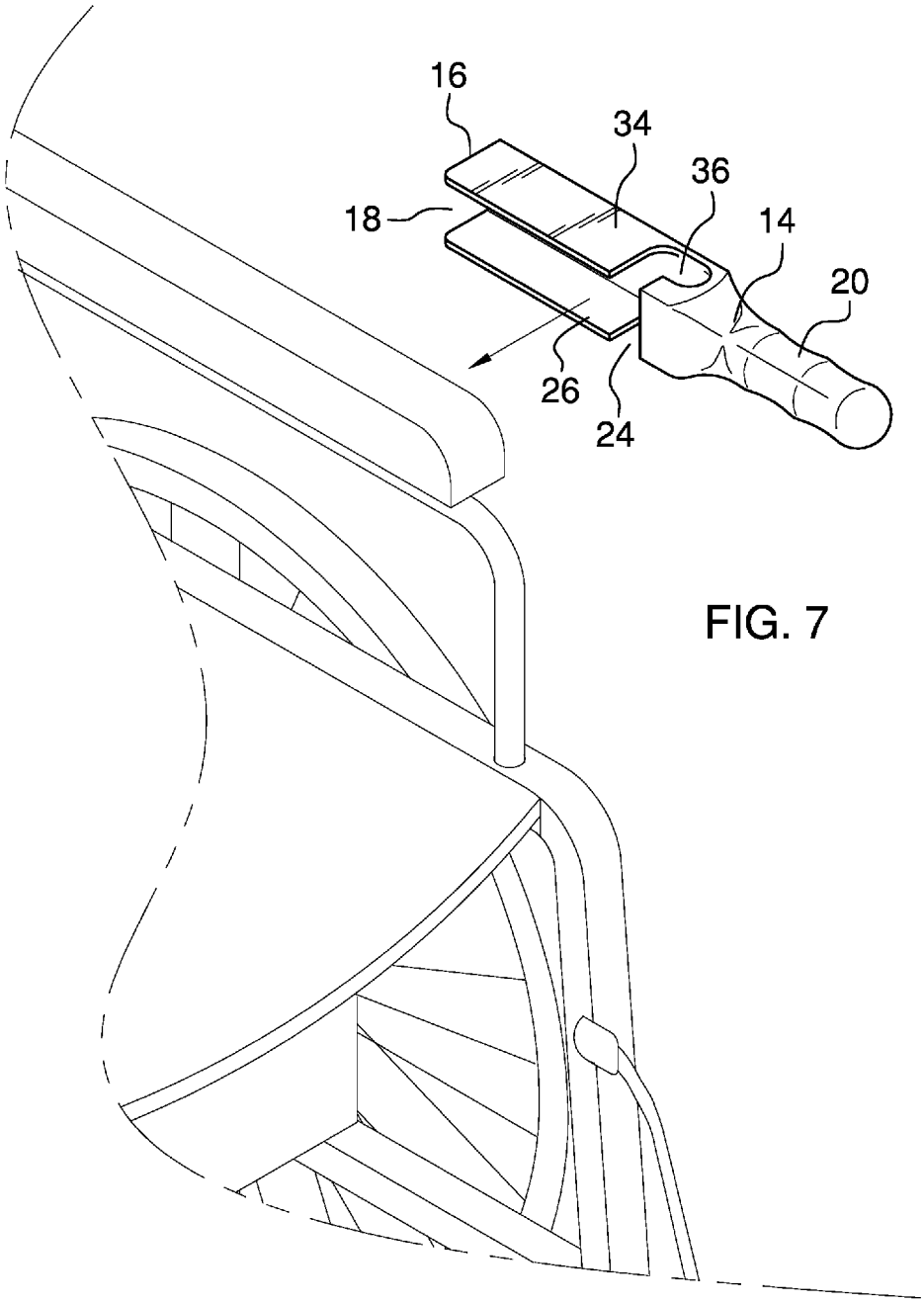
FIG. 7 is an in-use view of an embodiment of the disclosure.

With reference now to the drawings, and in particular to FIGS. 1 through 7 thereof, a new armrest extension device embodying the principles and concepts of an embodiment of the disclosure and generally designated by the reference numeral 10 will be described.

As best illustrated in FIGS. 1 through 7, the armrest extension device 10 generally comprises a tube 12 that has a first end 14, a second end 16 and a first side 18. The first end 14, and the second end 16 are open. The first side 18 is open from the second end 16 to proximate to the first end 14. In one embodiment, the tube 12 is substantially rectangularly shaped when viewed longitudinally. In another embodiment, the tube 12 is substantially squarely shaped when viewed longitudinally. In yet another embodiment, the tube 12 comprises metal. In still yet another embodiment, the tube 12 comprises aluminum.

A handle 20 is coupled to and extends linearly from the first end 14 the tube 12. In one embodiment, the handle 20 is substantially circularly shaped when viewed longitudinally. In another embodiment, the handle 20 comprises metal. In yet another embodiment, the handle 20 comprises aluminum.

A plurality of annular indentations 22 is positioned in the handle 20. The annular indentations 22 are arcuate. The annular indentations 22 are configured to enhance gripping of the handle 20 in a hand of a user.

A first cutout 24 is positioned in a bottom 26 of the tube 12 proximate to the first end 14. The first cutout 24 is substantially complementary to a diameter of a frame member that supports an armrest of a wheeled chair. The first cutout 24 is positioned in the tube 12 such that the tube 12 is configured to laterally insert the armrest into the first side 18, coincident with insertion of the frame member into the first cutout 24. The tube 12 is coupled to the armrest and the handle 20 is configured to be grasped in the hand of the user. In one embodiment, the first cutout 24 extends from the first side 18 of the tube 12 to a second side 28 of the tube 12. The first cutout 24 extends along the second side 28 to adjacent to the first end 14 of the tube 12 and defines a terminus 30 of the first cutout 24. The terminus 30 is rounded, such that the first cutout 24 is substantially boot shaped.

A separator 32 is coupled to the first side 18 of the tube 12 adjacent to the first end 14. The separator 32 extends inwardly toward the second side 28 of the tube 12. The separator 32 is positioned equally distant from a top 34 and the bottom 26 of the tube 12. The separator 32 is configured to abut an upper face of the frame member as the frame member is inserted into the first cutout 24.

A second cutout 36 is opposingly positioned to the first cutout 24 in the top 34 of the tube 12. The second cutout 36 is positioned in the tube 12 so that the tube 12 is selectively couplable to a left armrest and a right armrest of the wheeled chair.

In use, the tube 12 is configured to laterally insert the armrest into the first side 18, coincident with insertion of the frame member into the first cutout 24. The tube 12 is coupled to the armrest and the handle 20 is configured to be grasped in the hand of the user. The second cutout 36 is positioned in the tube 12 so that the tube 12 is selectively couplable to the left armrest and the right armrest of the wheeled chair.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An armrest extension device comprising:

a tube, said tube having a first end and a second end, said first end and said second end being open, said tube having a first side, said first side being open from said second end to proximate to said first end;

a handle coupled to and extending linearly from said first end said tube;

a first cutout, said first cutout being positioned in a bottom of said tube proximate to said first end, said first cutout being substantially complementary to a diameter of a frame member supporting an armrest of a wheeled chair;

wherein said first cutout is positioned in said tube such that said tube is configured for lateral insertion of the armrest into said first side coincident with insertion of the frame member into said first cutout, such that said tube is coupled to the armrest, wherein said handle is configured for grasping in a hand of a user; and a plurality of annular indentations positioned in said handle, said annular indentations being arcuate, wherein said annular indentations are positioned in said handle such that said annular indentations are configured for enhancing gripping of said handle in the hand of the user.

2. The device of claim 1, further including said tube being substantially rectangularly shaped when viewed longitudinally.

3. The device of claim 2, further including said tube being substantially squarely shaped when viewed longitudinally.

4. The device of claim 1, further including said tube and said handle comprising metal.

5. The device of claim 4, further including said tube and said handle comprising aluminum.

6. An armrest extension device comprising:

a tube, said tube having a first end and a second end, said first end and said second end being open, said tube having a first side, said first side being open from said second end to proximate to said first end;

a handle coupled to and extending linearly from said first end said tube, said handle being substantially circularly shaped when viewed longitudinally;

a first cutout, said first cutout being positioned in a bottom of said tube proximate to said first end, said first cutout being substantially complementary to a diameter of a frame member supporting an armrest of a wheeled chair; and wherein said first cutout is positioned in said tube such that said tube is configured for lateral insertion of the armrest into said first side coincident with insertion of the frame member into said first cutout, such that said tube is coupled to the armrest, wherein said handle is configured for grasping in a hand of a user.

7. The device of claim 6, further comprising:

said tube being substantially rectangularly shaped when viewed longitudinally, said tube being substantially squarely shaped when viewed longitudinally, said tube comprising metal, said tube comprising aluminum;

said handle comprising metal, said handle comprising aluminum;

a plurality of annular indentations positioned in said handle, said annular indentations being arcuate, wherein said annular indentations are positioned in said handle such that said annular indentations are configured for enhancing gripping of said handle in a hand of a user;

wherein said first cutout is positioned in said tube such that said tube is configured for laterally inserting the armrest into said first side coincident with inserting the frame member into said first cutout, such that said tube is coupled to the armrest wherein said handle is configured for grasping in the hand of the user, said first cutout extending from said first side of said tube to a second side of said tube, said first cutout extending along said second side to adjacent to said first end of said tube defining a terminus of said first cutout, said terminus being rounded such that said first cutout is substantially boot shaped;

a separator coupled to said first side of said tube adjacent to said first end, said separator extending inwardly toward said second side of said tube, said separator being positioned equally distant from a top and said bottom of said tube, wherein said separator is positioned in said tube such that said separator is configured for abutting an upper face of the frame member as the frame member is inserted into said first cutout;

a second cutout, said second cutout being opposingly positioned to said first cutout in said top of said tube, wherein said second cutout is positioned in said tube such that said tube is selectively couplable to a left armrest and a right armrest of the wheeled chair; and wherein said second cutout is positioned in said tube such that said tube is selectively couplable to the left armrest and the right armrest of the wheeled chair.

8. The device of claim 1, further including said first cutout extending from said first side of said tube to a second side of said tube, said first cutout extending along said second side to adjacent to said first end of said tube defining a terminus of said first cutout, said terminus being rounded such that said first cutout is substantially boot shaped.

9. An armrest extension device comprising:

a tube, said tube having a first end and a second end, said first end and said second end being open, said tube having a first side, said first side being open from said second end to proximate to said first end;

a handle coupled to and extending linearly from said first end said tube;

a first cutout, said first cutout being positioned in a bottom of said tube proximate to said first end, said first cutout being substantially complementary to a diameter of a frame member supporting an armrest of a wheeled chair; and wherein said first cutout is positioned in said tube such that said tube is configured for lateral insertion of the armrest into said first side coincident with insertion of the frame member into said first cutout, such that said tube is coupled to the armrest, wherein said handle is configured for grasping in a hand of a user; and a separator coupled to said first side of said tube adjacent to said first end, said separator extending inwardly toward said second side of said tube, said separator being positioned equally distant from a top and said bottom of said tube, wherein said separator is positioned in said tube such that said separator is configured for abutting an upper face of the frame member as the frame member is inserted into said first cutout.

10. The device of claim 1, further including a second cutout, said second cutout being opposingly positioned to said first cutout in a top of said tube, wherein said second cutout is positioned in said tube such that said tube is selectively couplable to a left armrest and a right armrest of the wheeled chair.

* * * * *